US006095115A

United States Patent [19]

Fuchs

[11] Patent Number: 6,095,115

[45] Date of Patent: Aug. 1, 2000

[54] SELF-CLIPPING SLAVE PISTON DEVICE WITH LASH ADJUSTMENT FOR A COMPRESSION RELEASE ENGINE RETARDER

[75] Inventor: Neil Fuchs, New Hartford, Conn.

[73] Assignee: Diesel Engine Retarders, Inc., Wilmington, Del.

[21] Appl. No.: 09/241,859

[22] Filed: Feb. 2, 1999

Related U.S. Application Data

[60] Provisional application No. 60/073,377, Feb. 2, 1998.

[51] Int. Cl.[7] ..... F02D 13/04

[52] U.S. Cl. ..... 123/321

[58] Field of Search ..... 123/320, 321

[56] References Cited

U.S. PATENT DOCUMENTS

| | | |
|---|---|---|
| 3,220,392 | 11/1965 | Cummins . |
| 4,050,435 | 9/1977 | Fuller et al. . |
| 4,164,917 | 8/1979 | Glasson . |
| 4,399,787 | 8/1983 | Cavanagh . |
| 4,423,712 | 1/1984 | Mayne et al. . |
| 4,552,172 | 11/1985 | Krieger et al. . |
| 4,662,332 | 5/1987 | Bergmann et al. . |
| 4,711,210 | 12/1987 | Reichenbach . |
| 4,793,307 | 12/1988 | Quenneville et al. . |
| 4,848,289 | 7/1989 | Meneely . |
| 4,932,372 | 6/1990 | Meneely . |
| 4,957,275 | 9/1990 | Homes . |
| 5,000,145 | 3/1991 | Quenneville . |
| 5,036,810 | 8/1991 | Meneely . |
| 5,048,480 | 9/1991 | Price . |
| 5,048,489 | 9/1991 | Fischer et al. . |
| 5,105,782 | 4/1992 | Meneely . |
| 5,161,500 | 11/1992 | Kubis et al. . |
| 5,161,501 | 11/1992 | Hu . |
| 5,183,018 | 2/1993 | Vittorio et al. . |
| 5,186,141 | 2/1993 | Custer . |
| 5,201,290 | 4/1993 | Hu . |
| 5,379,737 | 1/1995 | Hu . |
| 5,386,809 | 2/1995 | Reedy et al. . |
| 5,451,029 | 9/1995 | Krüger . |
| 5,460,131 | 10/1995 | Usko . |
| 5,462,025 | 10/1995 | Israel et al. . |
| 5,511,460 | 4/1996 | Custer . |
| 5,586,533 | 12/1996 | Feucht . |
| 5,595,158 | 1/1997 | Faletti et al. . |
| 5,787,859 | 8/1998 | Meistrick et al. . |
| 5,809,964 | 9/1998 | Meistrick et al. . |

*Primary Examiner*—Henry C. Yuen
*Assistant Examiner*—Arnold Castro
*Attorney, Agent, or Firm*—Collier, Shannon, Rill & Scott, PLLC

[57] ABSTRACT

An apparatus for limiting the travel of a slave piston in a slave piston cylinder in a compression release engine retarder is disclosed. The apparatus is connected to a hydraulic circuit and comprises an internal passageway in the slave piston head. The internal passageway comprises a vertical bore, a horizontal bore, and an annular channel which together provide a path for bleeding off the pressure on the top of the slave piston when the annular channel and an aperture in the slave piston cylinder are aligned. The bleeding of the hydraulic pressure on top of the slave piston clips the motion of the slave piston at a desired stroke. The apparatus includes a locking adjustable foot on the slave piston stem which provides a means to adjust the lash.

21 Claims, 2 Drawing Sheets

SELF-CLIPPING SLAVE PISTON DEVICE WITH LASH ADJUSTMENT FOR A COMPRESSION RELEASE ENGINE RETARDER

CROSS-REFERENCE TO RELATED PATENT APPLICATION

This application relates to and claims priority on provisional application Ser. No. 60/073,377 filed Feb. 2, 1998 and entitled "Self-Clipping Slave Piston Device with Lash Adjustment for a Compression Release Engine Retarder."

FIELD OF THE INVENTION

The present invention relates generally to compression release engine retarders, and more particularly to a mechanism for limiting the maximum displacement of slave pistons in valve actuation systems and adjusting the lash in those systems.

BACKGROUND OF THE INVENTION

Compression release-type engine retarders are well-known in the art. Engine retarders are designed to temporarily convert an internal combustion engine of either the spark ignition or compression ignition type into an air compressor. The fundamental braking power is achieved by preventing fuel injection during the compression stroke of a piston, compressing the captured air mass, and releasing the compressed air at or near a top-dead-center position of a piston into an exhaust manifold. The energy expended in compression release braking systems is controlled, for the most part, by the volume of gas compressed, the timing of the release of the gas into the exhaust manifold and the amount of gas released. A compression release retarder decreases the kinetic energy of an engine by opposing the upward motion of the engine's pistons on the compression stroke. As a piston travels upward on its compression upstroke, the gases that are trapped in the cylinder are compressed. The compressed gases oppose the upward motion of the piston. When the piston nears the top of its stroke, an exhaust valve is opened to "release" the compressed gases. The pressure having been released from the cylinder, the piston cannot recapture the energy stored in the compressed gases on the subsequent expansion downstroke. In so doing, the engine develops retarding power to help slow down the vehicle. This provides the operator with increased control over the vehicle.

A properly designed and adjusted compression release-type engine retarder can develop retarding power that is a substantial portion of the power developed by the engine on positive power. Compression release-type retarders of this type supplement the braking capacity of the primary vehicle wheel braking system. In so doing, these retarders may substantially extend the life of the primary wheel braking system of the vehicle.

The basic design of a compression release type engine retarding system is disclosed in U.S. Pat. No. 3,220,392 to Cummins, which is incorporated herein by reference. The compression release-type engine retarder disclosed in the Cummins patent employs a hydraulic control system to operate the exhaust valves to effect the compression release event. The hydraulic control system engages the engine's existing valve actuation system, namely, the rocker arms of the engine.

When the engine is operating under positive power, the hydraulic control system of the compression release retarder is disengaged from the valve actuation system, so that no compression release event occurs. When compression release retarding is desired, the engine is deprived of fuel and the hydraulic control system of the compression release brake engages the valve actuation system of the engine. The valve actuation system drives the compression release retarder to produce compression release events at the appropriate times.

The hydraulic systems of compression release engine retarders typically have a number of components. A master piston engages the valve control system of the engine, typically at a rocker arm. A solenoid valve is typically actuated to supply engine oil to fill the hydraulic circuits of the compression release engine retarder, when retarding is desired. The master piston, in turn, is hydraulically connected to a slave piston. The slave piston is connected to an exhaust valve of the engine.

When the compression release retarder is actuated, the rocker arm pushes against the master piston. The motion of the master piston forces the slave piston to actuate, which in turn opens the exhaust valve of the internal combustion engine at a point near the end of the compression stroke. Much of the energy stored by compressing the gas in the cylinder is not recovered during the subsequent expansion or power stroke of the engine. Instead, it is dissipated through the exhaust and radiator systems of the engine. By dissipating the energy developed by compressing the cylinder charge, the compression release-type retarder slows the vehicle down.

Typically, it is desirable to use the compression release-type engine retarder to open an engine exhaust valve as late in the compression stroke as practical. In this way, the engine develops greater compression, allowing more energy to be dissipated through the compression release retarder. Delaying the opening of the exhaust valve in the compression release event, however, may substantially increase the loading on critical engine components. The force required to open the exhaust valve during the compression release event is transmitted back through the hydraulic system through the push tubes and the camshaft. This can impose substantial force on certain engine components. If the timing is delayed long enough, the pressure in the cylinder can become high enough to exceed the ability of the compression release retarder to properly open the exhaust valve.

In a compression release engine retarder it is desirable to provide accurate timing of exhaust valve opening. To this end, it is advantageous in these systems to apply sharp hydraulic pulses to the slave pistons so that they open the exhaust valves rapidly. In order to both stop the slave pistons' motion and prevent excessive opening of the associated exhaust valves, reset or "clipping" mechanisms have been employed to reduce the hydraulic fluid pressure when either the hydraulic fluid pressure reaches the predetermined maximum or the slave pistons have reached the end of their desired stroke. The term "clipping" generally refers to modification of the forward motion of the slave piston to control peak brake pressure, to limit the total travel of the slave piston or to reduce the length of the slave motion event. The disadvantages of excessive slave piston travel include excessive exhaust valve travel and possible contact of exhaust valves with the engine piston, increased overall braking apparatus and engine height, and overtravel of the slave piston return spring.

A typical slave piston design incorporating such a reset mechanism uses a lash-adjusting screw containing a reciprocating plunger that makes a facet over a hole in the slave piston surface. A means for adjusting the lash—or cold-engine clearance between the slave piston and the valve stem—is desirable in most valve actuation systems. In the typical design, the travel of the reciprocating plunger is arrested upon contact with a press-in pin or retaining ring that fits in a slot within the body of the screw. However, this system is relatively costly to manufacture and assemble due to the complex configurations of its various parts, the need to test it to ensure that the pin or retaining ring will not come out, etc. Failure of the retaining ring is a problem in such prior art devices.

The lash adjustment screw in prior art devices is typically contained in a housing at the top of the slave piston cylinder. Because the lash adjustment screw position is variable, the slave piston cylinder manufacturing datum, or reference position, is not fixed. This makes the device difficult to manufacture to a tightly controlled clipping position specification. The lash-adjusting screw may also cause a problem if it is hollow at the point at which it intersects the housing or other mounting because it may break if tightened excessively.

Other devices have been tried to "clip" the forward stroke of the slave piston to, for example, prevent excessive travel of the associated engine exhaust valves which cause them to contact the top of the engine piston at or near its top dead center position. Mechanisms for producing such slave piston clipping are shown, for example, in U.S. Pat. No. 5,511,460 to Custer, U.S. Pat. No. 5,201,290 to Hu, U.S. Pat. No. 5,787,859 to Meistrick et al. and U.S. Pat. No. 5,809,964 to Meistrick et al, all of which are assigned to the same assignee as the present invention and are incorporated herein by reference. These mechanisms typically include components for opening an aperture in the slave piston when the forward stroke of the slave piston has progressed to a predetermined point. This allows hydraulic fluid to bleed from the slave piston cylinder, thereby preventing the slave piston from moving forward beyond the point at which the aperture is open. The problem with prior slave piston clipping mechanisms is that they typically employ adjusting screws having tight tolerances which are difficult and expensive to manufacture. U.S. Pat. Nos. 5,787,859 and 5,809,964 to Meistrick et al. disclose stroke limiting in connection with a bifurcated slave piston, in contrast to the simpler, single slave piston of the present invention.

The slave piston clipping device of the present invention may be used in conjunction with other devices which alter, advance or retard the movement of a slave piston, such as the device disclosed in U.S. Pat. No. 5,186,141 to Custer, which is assigned to the same assignee as the present invention and is incorporated herein by reference.

Thus, investigation is still ongoing to find a simple, cost-effective method to limit the travel of a slave piston in a compression release engine retarder.

OBJECTS OF THE INVENTION

It is therefore an object of the present invention to provide an improved slave piston clipping apparatus.

It is another object of the present invention to limit the travel of a slave piston in a compression release engine retarder.

It is yet another object of the present invention to provide a simple apparatus for limiting the travel of a slave piston in a compression release engine retarder.

It is still another object of the present invention to limit the travel of a slave piston in a compression release engine retarder so that the associated engine exhaust valves do not contact the engine piston.

It is a further object of the present invention to provide a slave piston clipping apparatus which is inexpensive to manufacture.

It is yet a further object of the present invention to provide a slave piston clipping apparatus which incorporates lash adjustment.

It is still a further object of the present invention to provide an apparatus for limiting the travel of a slave piston in a compression release engine retarder which avoids the off-line lash-adjusting screw and plunger assembly process.

It is another object of the present invention to provide an easily manufactured lash adjustment apparatus in a compression release engine retarder slave piston device.

It is yet another object of the present invention to provide a self-locking lash adjustment apparatus in a compression release engine retarder slave piston device.

It is still another object of the present invention to provide improved slave piston reset apparatus.

It is a further object of the present invention to control travel of a slave piston return spring.

It is yet a further object of the present invention to provide a slave piston clipping apparatus which reduces overall engine height.

It is still a further object of the present invention to provide a slave piston clipping apparatus which has an improved clipping effect.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicants have developed an innovative and economical apparatus for limiting the travel of a slave piston in a slave piston cylinder in a compression release engine retarder. The apparatus of the present invention comprises a slave piston having a head and a stem disposed thereon and a slave piston cylinder having a wall and being connected to a hydraulic circuit so that when hydraulic fluid passes through the wall of the slave piston cylinder at an upper end of the slave piston cylinder, the slave piston moves down along a longitudinal axis toward a lower end of the slave piston cylinder to actuate at least one engine valve.

The apparatus of the present invention further comprises a first aperture in the slave piston cylinder wall, the first aperture forming the entrance to a hydraulic fluid supply line; a second aperture in the slave piston cylinder wall, the second aperture forming the entrance to a hydraulic fluid return conduit; and an internal passageway in the slave piston, the internal passageway providing communication between the hydraulic fluid supply line and the hydraulic fluid return conduit upon travel of the slave piston for a defined distance along the longitudinal axis of the slave piston cylinder.

The apparatus of the present invention further comprises a slave piston spring disposed in the slave piston cylinder and biased to urge the slave piston generally upward against the pressure in the hydraulic circuit, wherein the head of the slave piston is slidably disposed in the upper end of the slave piston cylinder, and the stem of the slave piston extends longitudinally from the slave piston head into the lower end of the slave piston cylinder.

The slave piston head further comprises an annular channel providing, in a first position, occlusion of the second aperture, and in a second position, opening of the second aperture to thereby permit communication between the hydraulic fluid supply line and the hydraulic fluid return conduit.

The internal passageway further comprises a vertical bore disposed in the slave piston head parallel with the longitudinal axis of the slave piston cylinder, and a horizontal bore diametrically spanning the slave piston head, such that the horizontal bore communicates with the vertical bore and the annular channel.

The apparatus of the present invention further comprises an adjustable foot disposed on the slave piston stem for varying the length of the slave piston stem.

Applicants have also developed a lash adjustment apparatus for a compression release engine retarder slave piston device. The lash adjustment apparatus provides means for adjusting the lash of a slave piston in a slave piston cylinder, comprising a slave piston having a head and a stem disposed thereon, a slave piston cylinder having a wall and being connected to a hydraulic circuit so that when hydraulic fluid passes through the wall of the slave piston cylinder at an upper end of the slave piston cylinder, the slave piston moves down along a longitudinal axis of the slave piston cylinder toward a lower end of the slave piston cylinder to actuate at least one engine valve.

The lash adjusting apparatus comprises an adjustable foot disposed on the slave piston stem for varying the length of the slave piston stem; a jam nut disposed on the adjustable foot for securing the adjustable foot to maintain a particular length of the slave piston stem; and a jam nut spring biased to engage the adjustable foot for automatically locking the adjustable foot at the particular length of the slave piston stem.

In the lash adjusting apparatus, the adjustable foot and the jam nut cooperate to maintain the lash at a predetermined setting. The apparatus further comprises a longitudinal slave piston stem, extending from the slave piston head into the lower end of the slave piston cylinder, and the slave piston stem further comprises a threaded end. The adjustable foot further comprises an inner surface and an outer surface, the inner surface being threaded for engagement with the threaded end of the slave piston stem, and the outer surface having planar facets, wherein the adjustable foot is rotatable to vary the effective length of the slave piston stem and thereby vary the lash of the engine retarder. The jam nut is slidably disposed on the slave piston stem, and the jam nut may be shaped for engaging with the planar facets of the adjustable foot and may be spring-biased for engaging the adjustable foot to prevent rotation of the adjustable foot, thereby maintaining the lash of the engine retarder at a predetermined value.

The slave piston head of the lash adjusting invention further comprises an annular channel providing, in a first position, occlusion of the second aperture, and in a second position, opening of the second aperture to thereby permit communication between the hydraulic fluid supply line and the hydraulic fluid return conduit whereby the travel of the slave piston is limited.

Applicants further disclose an apparatus in a compression release engine retarder for limiting the travel and adjusting the lash of a slave piston in a slave piston cylinder, wherein the slave piston has a head and a stem disposed thereon and the slave piston cylinder has a wall and may be connected to a hydraulic circuit so that when hydraulic fluid passes through the wall of the slave piston cylinder at an upper end of the slave piston cylinder, the slave piston moves down along a longitudinal axis toward a lower end of the slave piston cylinder to actuate at least one engine valve. The apparatus comprises a first aperture in the slave piston cylinder wall, the first aperture forming the entrance to a hydraulic fluid supply line; a second aperture in the slave piston cylinder wall, the second aperture forming the entrance to a hydraulic fluid return conduit; a slave piston spring disposed in the slave piston cylinder and biased to urge the slave piston generally upward against the pressure in the hydraulic circuit; the slave piston head, slidably disposed in the upper end of the slave piston cylinder, having an annular channel; the slave piston stem, extending longitudinally from the slave piston head into the lower end of the slave piston cylinder; an internal passageway in the slave piston, comprising a vertical bore disposed in the slave piston head parallel with the longitudinal axis of the slave piston cylinder, and a horizontal bore diametrically spanning the slave piston head, such that the horizontal bore communicates with the vertical bore and the annular channel, providing communication between the hydraulic fluid supply line and the hydraulic fluid return conduit when the annular channel and the second aperture are aligned; an adjustable foot disposed on the slave piston stem for varying the length of the slave piston stem; a jam nut disposed on the adjustable foot for securing the adjustable foot to maintain a particular length of the slave piston stem; and a jam nut spring biased to engage the adjustable foot for automatically locking the adjustable foot at the particular length of the slave piston stem.

The annular channel provides, in a first position, occlusion of the second aperture, and in a second position, opening of the second aperture to thereby permit communication between the hydraulic fluid supply line and the hydraulic fluid return conduit; the adjustable length of the longitudinal stem varies the lash of the engine retarder; the adjustable foot and the jam nut cooperate to maintain the lash at a predetermined setting; the slave piston stem further comprises a threaded end and the adjustable foot further comprises an inner surface and an outer surface, the inner surface being threaded for engagement with the threaded end of the slave piston stem, and the outer surface having planar facets, wherein the adjustable foot is rotatable to vary the effective length of the slave piston stem and thereby vary the lash of the engine retarder; and the jam nut is slidably disposed on the slave piston stem, the jam nut being shaped for engaging with the planar facets of the adjustable foot and spring-biased for engaging the adjustable foot to prevent rotation of the adjustable foot, thereby maintaining the lash of the engine retarder at a predetermined value.

The novel clipping apparatus and the novel lash adjustment means of the present invention are easy and inexpensive to manufacture and provide improved clipping effect and lash adjustment over other devices.

It is to be understood that both the foregoing general description and the following detailed description are exemplary and explanatory only, and are not restrictive of the invention as claimed. The accompanying drawings, which are incorporated here and by reference, and which constitutes part of the specification, illustrate certain embodiments of the invention, and together with the detailed descriptions served to explain the principles of the present invention.

DETAILED DESCRIPTION OF THE PREFERRED EMBODIMENTS

Reference will now be made in detail to a preferred embodiment of the self-clipping slave piston of the present invention, an example which is illustrated in the accompanying drawings. An embodiment of the present invention is shown in FIG. 1 as device 10.

Figure 1:
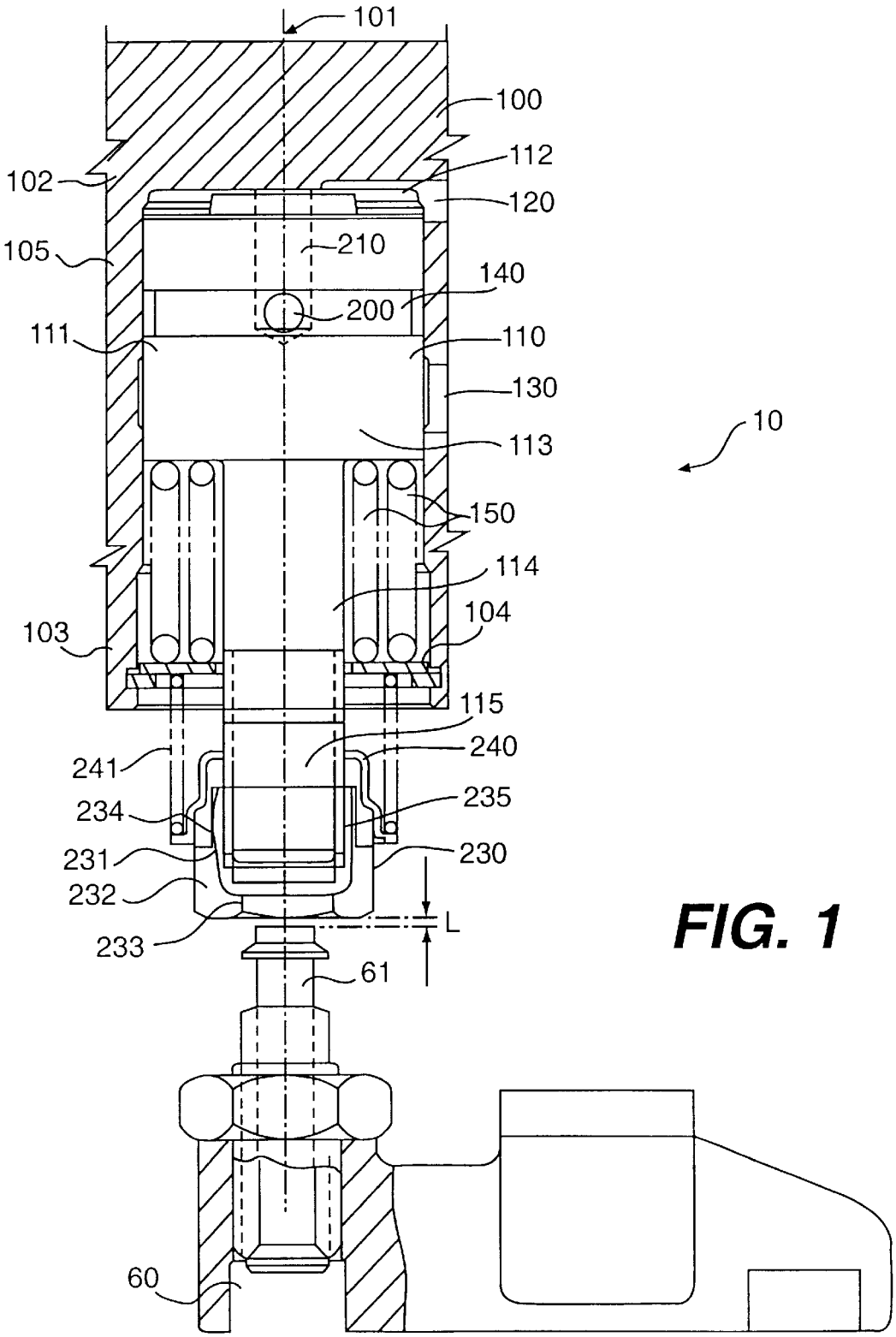
FIG. 1 is a cross-sectional view of a slave piston with an embodiment of the clipping assembly and lash adjustment mechanism of the present invention.

In the embodiment shown in FIG. 1, the apparatus of the present invention comprises slave piston cylinder 100, slave piston 110, and spring 150.

As embodied herein, slave piston cylinder 100 comprises wall 105, upper end 102, and lower end 103 and has longitudinal axis 101. Slave piston cylinder further comprises first aperture 120 and second aperture 130. In this embodiment, first aperture 120 is disposed generally in wall 105 in upper end 102 of slave piston cylinder 100, while second aperture 130 is disposed in wall 105 of slave piston cylinder 100 between the upper portion 102 and the lower portion 103 thereof.

As embodied herein, slave piston 110 generally comprises head 111 and stem 114 and is centered on longitudinal axis 101 of slave piston cylinder 100. Slave piston 110 comprises annular channel 140, horizontal bore 200 and vertical bore 210. Annular channel 140 and horizontal bore 200 are preferably disposed in slave piston head 111. In this embodiment of the invention, horizontal bore 200 diametrically spans head 111, with each end of horizontal bore 200 opening within annular channel 140.

As embodied herein, vertical bore 210 is axially disposed in head 111 and preferably subtends top face 112 of head 111 and horizontal bore 200. In this embodiment of the invention, vertical bore 210 communicates with horizontal bore 200 so that vertical bore 210 and horizontal bore 200 in conjunction provide communication between first aperture 120 and annular channel 140.

Stem 114 of slave piston 110 extends downward from head 111. Stem 114 is preferably cylindrical in shape, but in other embodiments of the invention may have a square cross-section or other cross-sectional shape. Stem 114 is preferably formed integrally with head 111 of slave piston 110. As embodied herein, stem 114 extends from bottom end face 113 of head 111 and is slidably disposed in lower end 103 of slave piston cylinder 100.

As embodied herein, stem 114 further comprises threaded end 115. Adjustable foot 230 is preferably disposed on threaded end 115 of stem 114. Adjustable foot 230 preferably comprises a generally cylindrical annular sleeve 231. Annular sleeve 231 comprises outer surface 232, having planar facets 233 thereon, and inner surface 234, having threads 235 thereon, for threaded engagement with threaded end 115 of stem 114. The threaded engagement of adjustable foot 230 and threaded end 115 permits the overall length of stem 114 to be adjusted either longer or shorter by rotation of adjustable foot 230. As embodied herein, jam nut 240 is slidably disposed on stem 114. Jam nut 240, by means of jam nut spring 241, is biased to automatically engage outer surface 232 of adjustable foot 230 to prevent rotation of adjustable foot 230, thus locking foot 230 and maintaining a desired overall length for stem 114. As embodied herein, jam nut 240 may be forced against jam nut spring 241 in a generally upward direction to disengage jam nut 240 from adjustable foot 230 and thus permit adjustable foot 230 to be rotated and adjust the overall length of stem 114. The distance "L" between the lower end of jam nut 230 and the upper end of exhaust valve actuation member 61 is the lash of the device. As embodied herein, jam nut 240 is designed to engage adjustable foot 230 with the ability to maintain a ±0.002 inch lash.

As embodied herein, spring 150 is disposed within the lower end 103 of slave piston cylinder 100. Spring 150 preferably acts against bottom cap 104 of slave piston cylinder 100 and against bottom end face 113 of head portion 111 of slave piston 110. Spring 150 preferably urges slave piston 110 in a generally upward direction.

Figure 2:
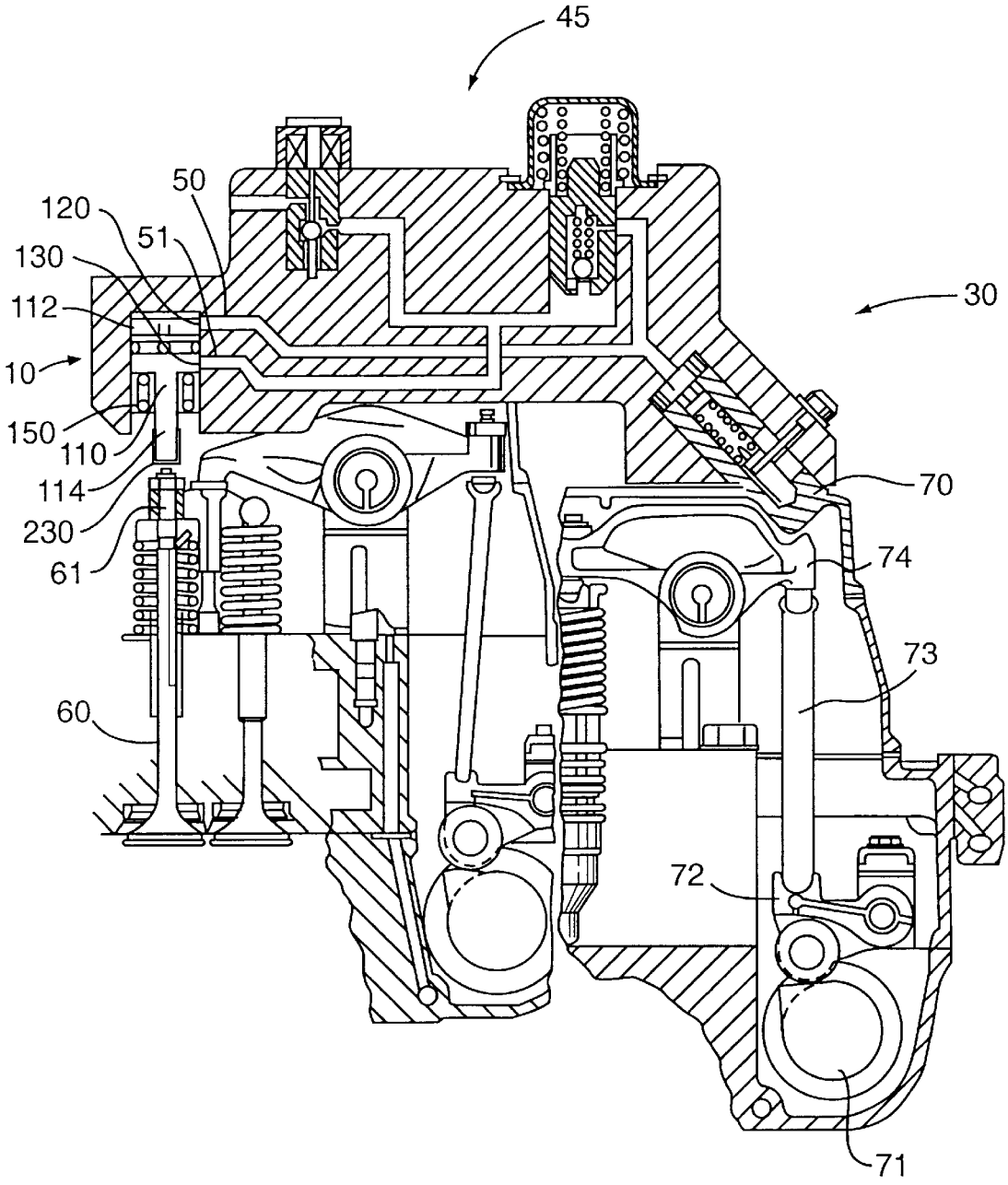
FIG. 2 is a simplified cross-sectional view of a compression release engine retarder system employing an embodiment of the clipping assembly and lash adjustment mechanism of the present invention.

Referring now to FIG. 2, an embodiment of a slave piston clipping device 10 of the present invention is shown installed in a compression release engine retarder system 30. In the operation of system 30, a high pressure pulse, generally in the range of 2,000–4,000 psi, is generated by master piston 70 and transmitted through hydraulic circuit 45. Hydraulic circuit 45 comprises hydraulic fluid supply line 50 and hydraulic fluid return conduit 51. The high pressure pulse is transmitted through hydraulic fluid supply line 50 to slave piston 110 via first aperture 120. The high pressure pulse is produced by the rotation of engine injection cam 71, which urges arm 72 to move rocker arm 74 via member 73. Member 73 urges master piston 70 against the hydraulic fluid in hydraulic fluid supply line 50. The force of the pressurized hydraulic fluid against the top end face 112 of slave piston 110 causes slave piston 110 to move in a generally downward direction within slave piston cylinder 100, overcoming the generally upward force exerted by spring 150. Once slave piston 110 has moved lash distance "L", adjustable foot 230 contacts exhaust valve actuation member 61 to open exhaust valve 60.

Referring again to FIG. 1, as embodied herein, slave piston 110 will continue to move generally downward under the force of hydraulic fluid entering through first aperture 120 and acting on top end face 112 of the piston until annular channel 140 comes into alignment with second aperture 130 in slave piston cylinder 100. When annular channel 140 comes into alignment with second aperture 130, hydraulic communication is established from first aperture 120 through vertical bore 210, horizontal bore 200, annular channel 140, and second aperture 130 to hydraulic fluid return conduit 51. The high pressure pulse developed by master piston 70 is thereby dissipated as hydraulic fluid bleeds off the top end face 112 of slave piston 110 through second aperture 130, into hydraulic fluid return conduit 51. When sufficient hydraulic pressure has been dissipated so that the pressure acting on top end face 112 of slave piston 110 is overcome by the generally upward force of springs 150, slave piston 110 preferably moves upward, sealing off second aperture 130 from annular channel 140. As embodied herein, when slave piston 110 has traveled upward a sufficient distance to disengage from exhaust valve actuating member 61, exhaust valve 60 will shut.

A novel slave piston clipping apparatus of the present invention thus clips the downward travel along axis 101 of slave piston 110 by bleeding off hydraulic fluid through second aperture 130 in slave piston cylinder 100. The distance that slave piston 110 travels along axis 101 prior to the clipping event is determined by the axial distance between annular channel 140 and second aperture 130. The greater the axial distance between annular channel 140 and second aperture 130, the greater the distance slave piston 110 will travel downward along axis 101 prior to the clipping event. The distance that slave piston 110 moves downward along longitudinal axis 101 before clipping determines the extent to which exhaust valve 60 is opened.

The timing of the opening of exhaust valve 60 relative to the actuation of slave piston 110 by the high pressure hydraulic pulse from master piston 70 is a function of the lash L. Lash L also determines the extent to which exhaust valve 60 opens before clipping of slave piston 110 occurs. As embodied herein, adjustable foot 230 provides a simple means of adjusting the length of stem 114 and thereby set lash L to a desired magnitude. The length of stem 114 is preferably adjusted by manually forcing jam nut 240 generally upward against the force of jam nut spring 241 until jam nut 240 disengages from adjustable foot 230. Adjustable foot 230 may then be freely rotated clockwise or counter clockwise as necessary to adjust the length of stem 114. When the desired length of stem 114, and concomitantly the lash L, have been adjusted to the desired magnitude, jam nut 240 may then be released so that it is urged downward by jam nut spring 241 to engagement with adjustable foot 230. Jam nut 240 prevents adjustable foot 230 from rotating and thereby maintains the length of stem 114, and concomitantly the lash L, at the desired value. Jam nut 240 is keyed to slave piston 110 to stop adjustable foot 230 from rotating.

The slave piston clipping apparatus of the present invention is simple to manufacture, and avoids to the need for offline assembly of an adjustment screw, as in prior art clip valve devices. The clipping effect of the present invention is better than prior art devices using an adjustment screw. For example, the slave piston travel-limiting apparatus of the present invention has been shown in tests to reduce overtravel, as compared to the device described in U.S. Pat. No. 5,201,290 to Hu, from 0.095 in. to 0.068 in., a 28% reduction.

It will be apparent to those skilled in the art that various modifications and variations can be made in the construction and configuration of the present invention without departing from the scope and spirit of the invention. For example, in the embodiment mentioned above, changes may be made in the structure and configuration of the compression release engine retarder system in which the slave piston travel limiting device of the present invention is installed. Further, a variety of cross sectional shapes of components, such as the slave piston cylinder and slave piston, of the device may be employed. A variety of materials may be used to construct the components of the apparatus of the invention. Thus, it is intended that the present invention cover the modifications and variations of the invention provided they come within the scope of the appended claims and their equivalents.

What is claimed is:

1. Apparatus in a compression release engine retarder for limiting the travel of a slave piston in a slave piston cylinder, said slave piston having a head and a stem disposed thereon and said slave piston cylinder having a wall and being connected to a hydraulic circuit so that when hydraulic fluid passes through said wall of said slave piston cylinder at an upper end of said slave piston cylinder, said slave piston moves down along a longitudinal axis toward a lower end of said slave piston cylinder to actuate at least one engine valve, said apparatus comprising:

a first aperture in said slave piston cylinder wall, said first aperture forming the entrance to a hydraulic fluid supply line;

a second aperture in said slave piston cylinder wall, said second aperture forming the entrance to a hydraulic fluid return conduit;

an internal passageway in said slave piston, said internal passageway providing communication between said hydraulic fluid supply line and said hydraulic fluid return conduit upon travel of said slave piston for a defined distance along said longitudinal axis of said slave piston cylinder; and an adjustable foot disposed on said slave piston stem for varying the length of said slave piston stem.

2. The apparatus of claim 1, further comprising a slave piston spring disposed in said slave piston cylinder and biased to urge said slave piston generally upward against the pressure in said hydraulic circuit.

3. The apparatus of claim 1, wherein said head of said slave piston is slidably disposed in said upper end of said slave piston cylinder, and said stem of said slave piston extends longitudinally from said slave piston head into said lower end of said slave piston cylinder.

4. The apparatus of claim 1, wherein said slave piston head further comprises an annular channel providing, in a first position, occlusion of said second aperture, and in a second position, opening of said second aperture to thereby permit communication between said hydraulic fluid supply line and said hydraulic fluid return conduit.

5. The apparatus of claim 4, wherein said internal passageway further comprises a vertical bore disposed in said slave piston head parallel with said longitudinal axis of said slave piston cylinder, and a horizontal bore diametrically spanning said slave piston head, such that said horizontal bore communicates with said vertical bore and said annular channel.

6. Apparatus in a compression release engine retarder for adjusting the lash of a slave piston in a slave piston cylinder, said slave piston having a head and a stem disposed thereon and said slave piston cylinder having a wall and being connected to a hydraulic circuit so that when hydraulic fluid passes through said wall of said slave piston cylinder at an upper end of said slave piston cylinder, said slave piston moves down along a longitudinal axis of said slave piston cylinder toward a lower end of said slave piston cylinder to actuate at least one engine valve, said apparatus comprising:

an adjustable foot disposed on said slave piston stem for varying the length of said slave piston stem;

a jam nut disposed on said adjustable foot for securing said adjustable foot to maintain a particular length of said slave piston stem; and a jam nut spring biased to engage said adjustable foot for automatically locking said adjustable foot at said particular length of said slave piston stem.

7. The apparatus of claim 6 wherein said adjustable foot and said jam nut cooperate to maintain said lash at a predetermined setting.

8. The apparatus of claim 6 further comprising a longitudinal slave piston stem, extending from said slave piston head into said lower end of said slave piston cylinder.

9. The apparatus of claim 8 wherein said slave piston stem further comprises a threaded end.

10. The apparatus of claim 9 wherein said adjustable foot further comprises an inner surface and an outer surface, said inner surface being threaded for engagement with said threaded end of said slave piston stem, and said outer surface having planar facets, wherein said adjustable foot is rotatable to vary the effective length of said slave piston stem and thereby vary the lash of said engine retarder.

11. The apparatus of claim 10 wherein said jam nut is slidably disposed on said slave piston stem, said jam nut being shaped for engaging with said planar facets of said adjustable foot and spring-biased for engaging said adjustable foot to prevent rotation of said adjustable foot, thereby maintaining said lash of said engine retarder at a predetermined value.

12. The apparatus of claim 6, wherein said slave piston head further comprises an annular channel providing, in a first position, occlusion of said second aperture, and in a second position, opening of said second aperture to thereby permit communication between said hydraulic fluid supply line and said hydraulic fluid return conduit whereby the travel of said slave piston is limited.

13. Apparatus in a compression release engine retarder for limiting the travel and adjusting the lash of a slave piston in a slave piston cylinder, said slave piston having a head and a stem disposed thereon and said slave piston cylinder having a wall and being connected to a hydraulic circuit so that when hydraulic fluid passes through said wall of said slave piston cylinder at an upper end of said slave piston cylinder, said slave piston moves down along a longitudinal axis toward a lower end of said slave piston cylinder to actuate at least one engine valve, said apparatus comprising:

a first aperture in said slave piston cylinder wall, said first aperture forming the entrance to a hydraulic fluid supply line;

a second aperture in said slave piston cylinder wall, said second aperture forming the entrance to a hydraulic fluid return conduit;

a slave piston spring disposed in said slave piston cylinder and biased to urge said slave piston generally upward against the pressure in said hydraulic circuit;

said slave piston head, slidably disposed in said upper end of said slave piston cylinder, having an annular channel;

said slave piston stem, extending longitudinally from said slave piston head into said lower end of said slave piston cylinder;

an internal passageway in said slave piston, comprising a vertical bore disposed in said slave piston head parallel with said longitudinal axis of said slave piston cylinder, and a horizontal bore diametrically spanning said slave piston head, such that said horizontal bore communicates with said vertical bore and said annular channel, providing communication between said hydraulic fluid supply line and said hydraulic fluid return conduit when said annular channel and said second aperture are aligned;

an adjustable foot disposed on said slave piston stem for varying the length of said slave piston stem;

a jam nut disposed on said adjustable foot for securing said adjustable foot to maintain a particular length of said slave piston stem; and a jam nut spring biased to engage said adjustable foot for automatically locking said adjustable foot at said particular length of said slave piston stem.

14. The apparatus of claim 13, wherein said annular channel provides, in a first position, occlusion of said second aperture, and in a second position, opening of said second aperture to thereby permit communication between said hydraulic fluid supply line and said hydraulic fluid return conduit.

15. The apparatus of claim 13 wherein said adjustable length of said longitudinal stem varies the lash of said engine retarder.

16. The apparatus of claim 13 wherein said adjustable foot and said jam nut cooperate to maintain said lash at a predetermined setting.

17. The apparatus of claim 13 wherein said slave piston stem further comprises a threaded end and said adjustable foot further comprises an inner surface and an outer surface, said inner surface being threaded for engagement with said threaded end of said slave piston stem, and said outer surface having planar facets, wherein said adjustable foot is rotatable to vary the effective length of said slave piston stem and thereby vary the lash of said engine retarder.

18. The apparatus of claim 17 wherein said jam nut is slidably disposed on said slave piston stem, said jam nut being shaped for engaging with said planar facets of said adjustable foot and spring-biased for engaging said adjustable foot to prevent rotation of said adjustable foot, thereby maintaining said lash of said engine retarder at a predetermined value.

19. Apparatus in a compression release engine retarder for limiting the travel of a slave piston and for adjusting the lash of said slave piston in a slave piston cylinder, said slave piston having a head and a stem disposed thereon, comprising:

a hydraulic actuation system connected to said slave piston for actuating at least one engine valve; and an adjustable foot disposed on said slave piston stem for varying the length of said slave piston stem, said adjustable foot further comprising a jam nut disposed on said adjustable foot for securing said adjustable foot to maintain a particular length of said slave piston stem.

20. The apparatus of claim 18 further comprising a jam nut spring, said jam nut spring biased to engage said adjustable foot for automatically locking said adjustable foot at said particular length of said slave piston stem.

21. The apparatus of claim 20 wherein said adjustable foot and said jam nut cooperate to maintain said lash at a predetermined setting.

* * * * *